United States Patent [19]

Argade et al.

[11] 4,040,935

[45] Aug. 9, 1977

[54] PROTECTIVE COVERING FOR ELECTROLYTIC FILTER PRESS CELL FRAMES

[75] Inventors: Shyam D. Argade, Woodhaven; John J. Bortak, Plymouth; Stephen M. Collins, Trenton; Eugene Y. Weissman, Birmingham, all of Mich.

[73] Assignee: BASF Wyandotte Corporation, Wyandotte, Mich.

[21] Appl. No.: 567,293

[22] Filed: Apr. 11, 1975

[51] Int. Cl.[2] ..... C25B 1/26; C25B 1/16; C25B 9/00

[52] U.S. Cl. ..... 204/256; 204/258; 204/279

[58] Field of Search ..... 204/95, 98, 101, 266, 204/279, 281, 284, 258, 256

[56] References Cited

U.S. PATENT DOCUMENTS

| | | | |
|---|---|---|---|
| 3,415,733 | 12/1968 | Koch et al. | 204/279 |
| 3,743,592 | 7/1973 | Metcalff | 204/266 |
| 3,773,634 | 11/1973 | Stacey et al. | 204/98 |
| 3,791,947 | 2/1974 | Loftfield | 204/95 |
| 3,836,438 | 9/1974 | Sartre et al. | 204/279 |
| 3,864,236 | 2/1975 | Lindstrom | 204/258 X |
| 3,869,375 | 3/1975 | Ono et al. | 204/301 |
| 3,873,437 | 3/1975 | Pulver | 204/284 X |
| 3,891,533 | 6/1975 | Fletcher | 204/279 X |
| 3,933,617 | 1/1976 | Yamamoto et al. | 204/301 |

*Primary Examiner*—Arthur C. Prescott
*Attorney, Agent, or Firm*—Bernhard R. Swick; Arnold S. Weintraub; Robert E. Dunn

[57] ABSTRACT

Electrolytic filter press cell frames are provided with a polymeric protective covering which is either directly laminated thereonto or otherwise secured thereto. The protective covering is, preferably, a fluorinated hydrocarbon.

11 Claims, 2 Drawing Figures

PROTECTIVE COVERING FOR ELECTROLYTIC FILTER PRESS CELL FRAMES

BACKGROUND OF THE INVENTION

1. Field of the Invention

The present invention pertains to electrolytic filter press cells. More particularly, the present invention pertains to chlor-alkali electrolytic filter press cells. Even more particularly, the present invention pertains to protective coverings for chlor-alkali electrolytic filter press cell frames.

2. Prior Art

The advent of electrolytic filter press cells for the manufacture of chlorine and caustic has given rise to a wealth of technology with respect thereto. Because of the strong oxidation conditions present in the cell, much research has been expended to derive and define inexpensive materials of construction which will not degrade within the cell environment. Moreover, the prior art has sought materials which will enhance the useful life of the structures disposed within the cell. Thus, there has been taught heretofore the coating of electrodes with fluorohydrocarbons to protect the base material of the electrode. See, inter alia, U.S. Pat. Nos. 3,645,796; 3,461,044 and 3,679,568.

It is to be further appreciated with respect to the prior art that in most instances prolongation of the useful life has been directed to the electrodes, the diaphragm, if present, and the cell structure, including electrical connections. In connection herewith, it is to be noted that very little attention has been paid to the cell frame or barrier which separates adjacent electrodes. Generally, most cell frames are molded or otherwise manufactured from filled or unfilled synthetic resinous materials. Conventionally, most cell frames comprise polypropylene which may be filled with materials such as, asbestos or calcium silicate. Other types of synthetic resins used for cell frames include graphite-filled phenol-formaldehyde resins, as taught in U.S. Pat. No. 3,415,733. However, and as noted, filled or unfilled polypropylene is the prevalent material of construction for electrolytic filter press cell frames. This is especially true in a chlor-alkali environment.

However, it has been found that polypropylene cell frames are subject to chemical attack by the electrolytes. This chemical attack can result in a shortened life for the cell frame. More detrimental, however, is that the anolyte solution attacks the cell frame and forms particulate matter therewithin. This particulate matter has been found to plug or foul the cell diaphragm or membrane. This not only damages the diaphragm or membrane but, also, reduces cell efficiency. The present invention, as will subsequently be detailed, alleviates this problem. Concurrently, the present invention enables the use of materials for cell frame construction which are normally incompatible with the electrolyte solutions.

SUMMARY OF THE INVENTION

In accordance with the present invention, a protective covering for an electrolytic filter press cell frame is provided. The protective covering comprises a polymeric material which is inert to the electrolyte in contact therewith.

With respect to a chlor-alkali cell there is provided, in accordance herewith, a protective covering consisting essentially of a fluorinated hydrocarbon.

In a first embodiment of the invention, a vacuum molded sheet conforming to the shape of the cell frame and consisting essentially of a fluorinated hydrocarbon is secured to the cell frame. The sheet is secured to the frame through the bipolar connector or through other suitable means.

In an alternate embodiment of the present invention a filter press cell frame is laminated with a protective film consisting essentially of a fluorinated hydrocarbon.

Preferred fluorinated hydrocarbons include polytetrafluoroethylene and fluorinated ethylene-propylene copolymers.

For a more complete understanding of the present invention, reference is made to the following detailed description and accompanying drawing. In the drawing, like reference characters refer to like parts throughout the several views in which:

DESCRIPTION OF THE PREFERRED EMBODIMENTS

Figure 1:
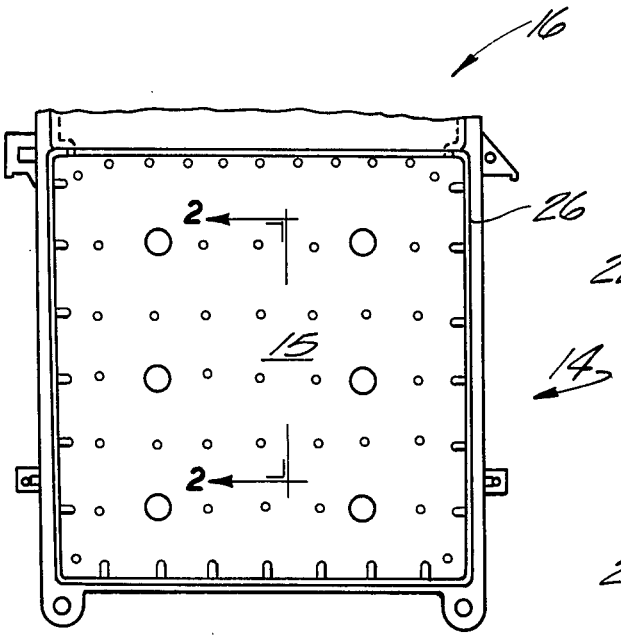
FIG. 1 is a side elevational view of a filter press cell frame.
Figure 2:
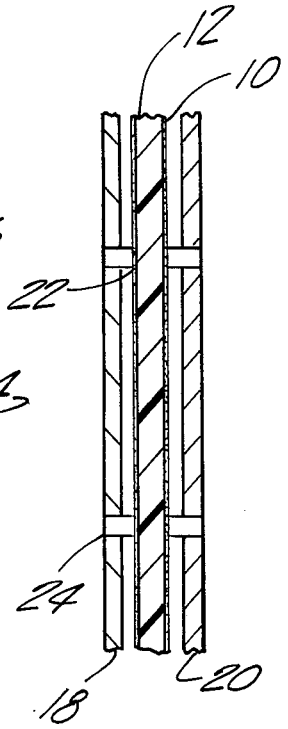
FIG. 2 is a broken, cross-sectional view taken along the line 2—2 of FIG. 1

At the outset it should be noted that the present invention is amenable for use in any and all electrolytic filter press cells, wherein the problems heretofore enumerated are encountered. Thus, the invention is amenable to a filter press cell frame with or without a central barrier segregating the anolyte compartment from the catholyte compartment. However, for a clear and concise understanding of the present invention, the following description will be made with reference to a bipolar chlor-alkali filter press cell frame having a central barrier.

Now with reference to the drawing, the present invention, as hereinbefore noted, comtemplates a protective covering 10 for an electrolytic filter press cell frame 12. The protective covering 10 is chemically inert to the electrolyte solutions, i.e. anolyte and catholyte, surrounding the frame 12.

Conventionally, the cell frame 12 generally, comprises a molded or otherwise formed synthetic resin, such as polypropylene or the like. The resin may be either filled or unfilled with inert materials, such as asbestos, calcium silicate and the like. As is known to those skilled in the art, the cell frame comprises a lower portion or section 14 having a central barrier 15 and an upper portion or section 16.

The lower section 14 has associated therewith the electrodes 18, 20, i.e. the cathode and anode, disposed on either side thereof. The lower section 14 and the associated electrodes are in contact with the brine solution which is subjected to the electrolytic process. As electrolysis occurs, both hydrogen and chlorine gases are evolved and these gases are collected and segregated in the upper portion 16 of the cell frame.

The protective covering 10 contemplated herein is provided about the lower portion 14 of the cell frame 12. The protective covering 10 is interposed between the diaphragm (not shown) and the cell frame on the anolyte side. Likewise, the catholyte side, also, has the protective covering secured thereto.

Because of the strong oxidation conditions existing within the filter press cell, the protective covering 10, preferably, consists essentially of a fluorinated hydrocarbon. Although other materials, such as polyphenylene oxide, its copolymers, polyarylsulfones, polyphenylene sulfides and the like can be used, fluorinated hydrocarbons are preferred. Fluorinated hydrocarbons have been found to be essentially inert to chemical attack or degradation within a chlor-alkali cell. Although any flourinated hydrocarbon can be used herein, it is preferred to employ fluorinated polyalkylenes. The fluorinated polyalkylenes can be further halogen substituted. Representative of the fluorinated polyalkylenes contemplated for use herein are, for example, polytetrafluoroethylene, fluorinated ethylene-propylene copolymers, polychlorotrifluoroethylene, chlorotrifluoroethylene, polyvinylidenefluoride, polyethylenechlorotrifluoroethylene, polyethylenetetrafluoroethylene, tetrafluorethylene-perfluorovinylether sulfonyl fluoride copolymers, perfluoroalkoxy-tetrafluoroethylene copolymers and the like, as well as mixtures thereof.

In the practice of the present invention, the preferred fluorinated polyalkylene is either polytetrafluoroethylene or fluorinated ethylene-propylene copolymers. Both of these products are widely known and commercially available.

Referring, again, to the drawing, and in a first embodiment of the invention a protective covering 10 comprises a sheet of fluorinated hydrocarbon. The sheet is vacuum formed or otherwise molded or shaped such that it conforms to the configuration of the lower section or portion 14 of the cell frame 12.

The sheet has a thickness ranging from about five mils to about one-quarter inch and is mounted directly to the lower portion of the cell frame. The sheet can be mounted to the frame by any suitable means. A particularly preferred means for mounting the sheet or film contemplates forming apertures 22 in the sheet during the formation thereof which are coincident with the points of connection for a bipolar connector 24.

The bipolar connector 24 can be of any suitable form, such as that disclosed in U.S. Pat. No. 3,788,966. The connector 24 is used to abuttingly contact the sheet to the cell frame.

In forming the sheet, extended edges 26 are provided which extend into the sealing area between the frames. The pressure applied to the frames in the sealing area is, therefore, also applied to the extended edges. The mechanical pressure thereby exerted cooperates with the bipolar connector to maintain the positioning of the sheet.

Additional support means, such as strips of fluorinated hydrocarbon or metal can, likewise, be used to secure the protective covering to the cell frame.

In an alternate embodiment of the present invention, the protective covering 10 is laminated or bonded onto the polymeric cell frame 12. Bonding is achieved by the application of heat and pressure to the covering and frame. In practicing this embodiment, a particularly preferred fluorinated hydrocarbon protective covering comprises a vinyl supported polytetrafluoroethylene, such as that sold by Lamart Corporation under the name T-18. This product is a vinyl supported polytetrafluoroethylene composite film laminate. The polytetrafluoroethylene is deposited onto the vinyl substrate and the vinyl becomes bonded to the cell frame.

It should be noted in this regard that lamination could be achieved with an adhesive. However, this is not a preferred method of practicing this embodiment. Adhesives are subject to attack by chlorine diffusion through the film and as such, they are at best, unreliable. "Heat welding" the cell frame is difficult or vitually impossible if there is a great difference in melting point being the film and the cell frame material. This latter welding technique would require temperatures normally not well tolerated by polypropylene and similar polymeric resins used to manufacture the frame.

It is to be appreciated that by the practice of the present invention the cell frame, per se, is isolated from the electrolytes. Thus, by disposing the protective covering about the cell frame it is possible to utilize materials of construction for the cell frame which would otherwise be incompatible with the electrolytes.

Having thus described the invention, what is claimed is:

1. In a bipolar electrolytic filter press cell of the type having a polypropylene cell frame interposed between adjacent electrodes, the bipolar cell having bipolar connectors for transmitting electrical energy to the cell, the improvement which comprises:

a. a protective covering mounted to the cell frame the protective covering being chemically inert to the electrolytes, the covering being configured to the configuration of the cell frame, and b. means for mounting the covering to the cell frame.

2. The improvement of claim 1 wherein the protective covering comprises a film which is bonded to the cell frame, the bond defining the means for mounting.

3. The improvement of claim 1 wherein:

a. the filter press cell is a chlor-alkali cell, the cell further comprising a diaphragm and a cell barrier formed integrally with the cell frame, the cell frame and barrier both being formed from polypropylene, the protective covering being interposed between the diaphragm and the cell barrier, and b. the protective covering consists essentially of a fluorinated hydrocarbon.

4. The improvement of claim 3 wherein the fluorinated hydrocarbon is selected from the group consisting of polytetrafluoroethylene, fluorinated ethylene-propylene copolymers, polychlorotrifluoroethylene, chlorotrifluoroethylene, polyvinylidenefluoride, polyethylenechlorotrifluoroethylene, polyethylenetetrafluoroethylene, tetrafluoroethylene-perfluorovinylether sulfonyl fluoride copolymers and mixtures thereof.

5. The improvement of claim 4 wherein the protective covering comprises a sheet formed to the same configuration as the cell barrier and is either polytetrafluoroethylene or a fluorinated ethylene-propylene copolymer.

6. The improvement of claim 5 wherein the sheet includes extended edges, the edges extending into the sealing area of the filter press cell.

7. The improvement of claim 4 wherein the protective covering comprises a film which is bonded to the cell barrier and the fluorinated hydrocarbon consists essentially of a polytetrafluoroethylene film on a vinyl substrate.

8. In a chlor-alkali bipolar electrolytic filter press cell of the type having a polypropylene cell frame, the cell frame having a central barrier, a diaphragm adjacent the central barrier and bipolar electrical connectors for transmitting electrical energy to the cell, the improvement which comprises:

a. a protective covering mounted to the cell frame, the covering being configured to the configuration of the cell frame, the covering consisting essentially of a fluorinated hydrocarbon and being interposed between the diaphragm and the barrier, and b. means for mounting the covering to the cell frame.

9. The improvement of claim 8 wherein:

the covering is a sheet which is provided with a plurality of apertures, the apertures being coincident with the points of connection for the bipolar connector, the apertures and bipolar connectors cooperating to define the means for mounting.

10. The improvement of claim 9 wherein:

the sheet has a thickness of from about five mils to about one-quarter inch.

11. The improvement of claim 8 wherein:

the covering is a film, the film being bonded onto the barrier, the bonding defining the means for mounting.

* * * * *